US006796791B1

(12) United States Patent
Chung

(10) Patent No.: US 6,796,791 B1
(45) Date of Patent: Sep. 28, 2004

(54) LIGHTER COMPRISING SAFETY MECHANISM

(75) Inventor: Aman Kai man Chung, Shatin (HK)

(73) Assignee: Pollyconcept Holding SA, Sucy-en-Brie (FR)

( * ) Notice: Subject to any disclaimer, the term of this patent is extended or adjusted under 35 U.S.C. 154(b) by 0 days.

(21) Appl. No.: 10/129,779

(22) PCT Filed: Nov. 9, 2000

(86) PCT No.: PCT/FR00/03128

§ 371 (c)(1),
(2), (4) Date: Sep. 16, 2002

(87) PCT Pub. No.: WO01/35026

PCT Pub. Date: May 17, 2001

(30) Foreign Application Priority Data

Nov. 10, 1999 (FR) ..... 99 14153

(51) Int. Cl.[7] ..... F23D 11/36
(52) U.S. Cl. ..... 431/153; 431/255
(58) Field of Search ..... 431/153, 255, 431/257, 129–141

(56) References Cited

U.S. PATENT DOCUMENTS 5,636,979 A 6/1997 McDonough et al.
5,829,963 A * 11/1998 Ichiwaka ..... 431/153
5,833,448 A * 11/1998 Doucet et al. ..... 431/153
6,077,070 A * 6/2000 Doucet et al. ..... 431/153

FOREIGN PATENT DOCUMENTS

WO WO 99/11973 3/1999

OTHER PUBLICATIONS

US 6,338,625, 1/2002, Adams et al. (withdrawn)*

* cited by examiner

*Primary Examiner*—James C. Yeung
(74) *Attorney, Agent, or Firm*—Young & Thompson

(57) ABSTRACT

A lighter includes a device generating a flame whereof one part called actuator is mobile along a longitudinal axis between a neutral position, wherein the device cannot generate a flame, and an active position, wherein the device can generate a flame, and a safety mechanism mobile between a locked position, wherein the safety mechanism locks the actuator in its neutral position and a released position allowing the actuator to move toward its active position. The safety mechanism includes a safety member having a part which, when the safety mechanism is in the locked position, is inclined relative to the longitudinal axis of the actuator in the direction thereof so as to be arranged against a stop and, when the safety mechanism is in released position, is arranged facing a housing.

29 Claims, 5 Drawing Sheets

F1
F2
A
B
ZZ'
XX'
90
92
92a
92b
94
96
98
100
100a
100b
100c
101
101a
102
103
103a
104
105a
105b
106
108
110
111
112
118
119
119a
120
122
124
126
128
132
14

LIGHTER COMPRISING SAFETY MECHANISM

BACKGROUND OF THE INVENTION

The invention relates to a lighter comprising a flame generation device whereof an actuator portion is mobile along a longitudinal axis between a rest position, wherein the device cannot generate a flame, and an active position wherein the device can generate a flame, and a safety mechanism mobile between a locked position wherein the safety mechanism blocks the actuator in its rest position and an unlocked position enabling the actuator to move towards its active position.

In this type of lighter, a safety mechanism is present to prevent unintended persons, such as children, from using the lighter and igniting a flame, thereby risking injury to themselves or to other persons.

DESCRIPTION OF THE RELATED ART

A lighter of the type described above wherein the safety mechanism is a safety member having a downwardly directed vertical portion and cooperating with a vertical abutment joined to the lighter when the safety mechanism is in its locked position, is shown in U.S. Pat. No. 5,145,358.

To go from the locked position to the unlocked position when the lighter is placed in a vertical position, the user must cause horizontal movement of the safety member, thereby separating it from the abutment, and at the end of its movement, must depress the actuator vertically to initiate the phenomenon of flame generation.

A lighter comprising a flame generation device and a safety mechanism is also known from U.S. Pat. No. 5,833,448.

The flame generation device comprises an actuator portion which is mobile between a rest position wherein the device cannot generate a flame and an active position wherein the device can generate a flame.

The safety mechanism of this lighter is an integral part of the actuator and has a projecting portion which cooperates with an abutment of the lighter in order to block the actuator when it is subjected to a typical force which any user employs to operate the lighter.

This force is aligned with an axis corresponding to that of the actuator.

The teaching of this patent indicates that to release the actuator, it must be tilted rearward and hence, simultaneously, the safety mechanism attached thereto, in order to separate the projecting portion of the safety mechanism from the abutment of the lighter.

An axial thrust force must then be applied in a known manner to the actuator to operate the lighter.

SUMMARY OF THE INVENTION

In the view of the documents cited above, the present invention seeks to find a new lighter striking a good compromise between its user-friendliness for a normal user and its difficulty of use by an unauthorized user.

The present invention therefore proposes a lighter comprising a flame generation device whereof an actuator portion is mobile along a longitudinal axis between a rest position, wherein the device cannot generate a flame, and an active position, wherein the device can generate a flame and, a safety mechanism mobile between a locked position wherein the safety mechanism blocks the actuator in its rest position and an unlocked position enabling the actuator to move toward its active position, wherein the safety mechanism comprising a safety member having an active portion which, in the locked position of the safety mechanism, is tilted towards the actuator with respect to the longitudinal axis ZZ' of the actuator so as to be disposed against an abutment and, in the unlocked position of the safety mechanism, is disposed facing a housing.

The present invention hence proposes a lighter safety mechanism of a novel design which provides increased safety with respect to an unauthorized user of the lighter.

The lighter safety mechanism according to the invention offers the advantage of being simpler to implement than that of the lighter described in U.S. Pat. No. 5,833,448 because it only provides for the pivoting motion solely of the safety mechanism about the actuator, and not the tilting movement of the entire actuator, as in the patent cited.

According to a preferred feature of the invention, to change position, the active portion of the safety member pivots with respect to the actuator while moving away from it.

Thus the movement to perform the unlocking of the safety mechanism is particularly simple to implement for the authorized user of the lighter knowing how to use it.

According to one feature of the invention, the safety member comprises a bearing portion which is adapted, under the action of a first force, to make a pivoting motion towards one end of the actuator to which a second force is applied to displace the actuator from its rest position towards its active position, the bearing portion being arranged at the level of the end of the actuator.

Thus, when the safety mechanism has been displaced from its locked position to its unlocked position by applying the first force, the bearing portion being disposed at the level of the end of the actuator, the user then merely needs to apply the second force naturally to the end of the actuator to displace it from its rest position to its active position.

At the end of the pivoting motion, when the safety mechanism is in the unlocked position, the first force is applied to the bearing portion in a direction forming an angle less than 90° with another direction along which the second force is applied to the end of the actuator.

Thus, at the end of the unlocking movement of the safety mechanism, the force applied by the user to terminate this movement is not, as described in U.S. Pat. No. 5,145,358, perpendicular to the other direction along which the second force is applied to the end of the actuator to conventionally operate the lighter, but, on the contrary, makes an angle less than 90° with it, thereby facilitating the coordination of the two movements and naturally guiding the user in the second movement.

Furthermore, it should be noted that the pivoting motion of the safety member proposed according to the invention is more difficult to achieve for an unauthorized user of the lighter, such as a child, than a simple translation motion, as provided in the lighter of U.S. Pat. No. 5,145,358.

In fact, an unauthorized user such as a child could inadvertently use the lighter of U.S. Pat. No. 5,145,358 by pressing its finger at different places on the grooved portion of the end of the actuator which is a non-negligible surface area if the force it applies to this portion is inadvertently oblique and not perpendicular thereto.

On the contrary, to cause a pivoting motion of the safety member of the lighter according to the invention, it is necessary, by definition, to pivot this member and thereby locate the pivot about which the movement is made.

Such a movement is hence theoretically more difficult to execute than a simple translation motion and, in all likelihood, a pivoting motion is more rarely applied unintentionally than a translation motion similar to the one described herein.

According to one feature, the pivoting motion is executed about an axis.

According to one feature, the safety member pivots about an axis perpendicular to the longitudinal axis of movement of the actuator.

According to one feature, the safety member is elastically maintained in its locked position.

According to another feature, the safety member comprises the bearing portion whose pivotal movement has an amplitude corresponding to the angle of tilt formed between the active portion and the longitudinal axis of the actuator.

According to one feature, the housing is elongated along an axis parallel to the longitudinal axis of displacement of the actuator such that, in the unlocked position of the safety mechanism, the active portion of the safety member engages in the housing when the actuator passes from its rest position to its active position.

According to another feature, the active portion of the safety member forms a flange.

According to one feature, the actuator comprises a cap to which a force is applied for displacing the actuator from its rest position to its active position, the safety member being arranged at the level of the cap.

According to a first and a second embodiment of the invention, the safety member forms at least one component mounted on the actuator.

More particularly, the safety member forms at least one element mounted on the cap of the actuator.

Advantageously, the addition of a safety member to the actuator does not put into question the entire design of the actuator.

According to a feature of the first and second embodiment, the safety member is fixed to the actuator via its pivotal axis.

This represents a particularly simple and effective means to fix the safety member.

According to a feature related to the first and second embodiment of the invention, the safety member comprises the bearing portion which is arranged around the pivotal axis.

According to a feature related to the first two embodiments of the invention, the flange of the safety member is attached to the bearing portion.

According to a feature related to the first two embodiments, the safety member comprises an inactive portion which is maintained in position with respect to the actuator.

The inactive portion does not participate in the pivoting motion of the safety member but, on the contrary, serves as a support point for the member during the pivoting motion and thereby limits the amplitude of the motion. The inactive portion is, for example, blocked by the actuator.

According to a feature of the first embodiment of the invention, the safety member comprises a spring having a central portion arranged inside the bearing portion of the member and around the pivotal axis and two end portions, one extending along the flange and the other merging with the inactive portion maintained in position with respect to the actuator.

This makes it possible to achieve a limited elastic deformation of the safety member during the pivoting motion.

According to a feature of the second embodiment, the inactive portion maintained in position with respect to the actuator is a flange which has a reduced thickness compared with the thickness of the bearing portion of the safety member.

This feature also makes it possible to achieve a limited elastic deformation of the safety member during the pivoting motion.

According to a feature related to the first two embodiments, the active and inactive portions of the safety member form between one another an angle less than 90° when the safety mechanism is in the locked position.

According to another feature of the first two embodiments of the invention, the bearing portion of the safety member is grooved and/or comprises a boss to facilitate its manipulation by a user of the lighter.

According to a third embodiment of the invention, the safety member forms one and the same member with the actuator.

In particular, the safety member forms one and the same member with the cap, which does not require reviewing the entire design of the actuator.

According to a feature related to the previous one, the safety member is connected to the actuator via an arm.

According to one feature related to the previous one, this arm has a curved general shape which acts as a hinge for the pivoting motion of the safety member.

According to a feature related to this third embodiment, the pivotal axis is placed at the level of the arm.

According to another feature related to this third embodiment, the safety member comprises an actuating head at least partially forming the bearing portion to which the force is applied to execute the pivoting motion and the flange forming the active portion of the member.

In particular, the actuating head and flange confer on the safety member a general T-shape having a leg that is formed of the flange.

According to another feature related to this third embodiment of the invention, a space is provided between the actuating head and the actuator.

This space enables the actuating head to be displaced during the pivoting motion of the safety member towards its unlocked position, while limiting the displacement.

BRIEF DESCRIPTION OF THE DRAWINGS

Other features and advantages will appear in the following description, which is given only by way of non-limiting example and made with reference to the accompanying drawings, in which.

DESCRIPTION OF THE PREFERRED EMBODIMENTS

Figure 1:
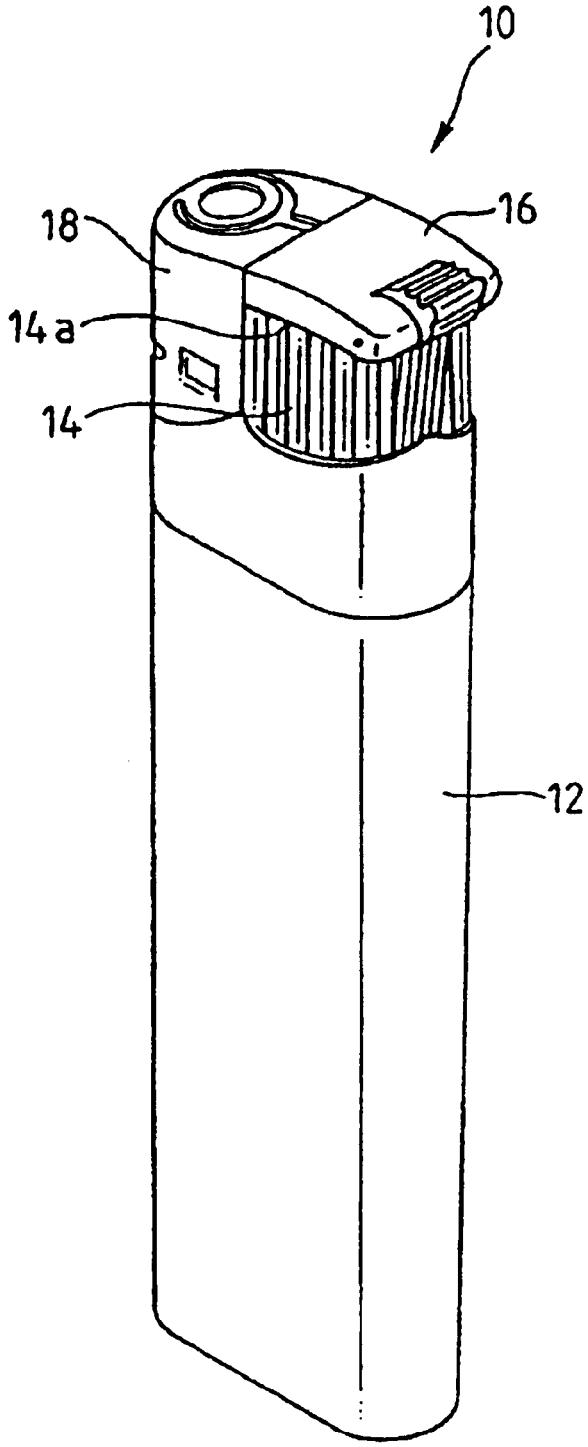
FIG. 1 is a perspective view of a lighter according to the present invention.

As shown in FIG. 1 and denoted by the general reference 10, a lighter according to the invention comprises a body 12 of elongated general form, a flame generation device comprising an actuator 14 whereof only one portion is shown in this figure.

The portion of the actuator shown in FIG. 1 represents an end 14*a* of the actuator which is provided with a cap 16 whereto the user of the lighter must apply a downward force, along the longitudinal axis of the lighter ZZ', to displace the actuator within the body 12.

The lighter also comprises a member 18 forming a wind guard to protect the flame generated by the lighter.

Figure 2A:
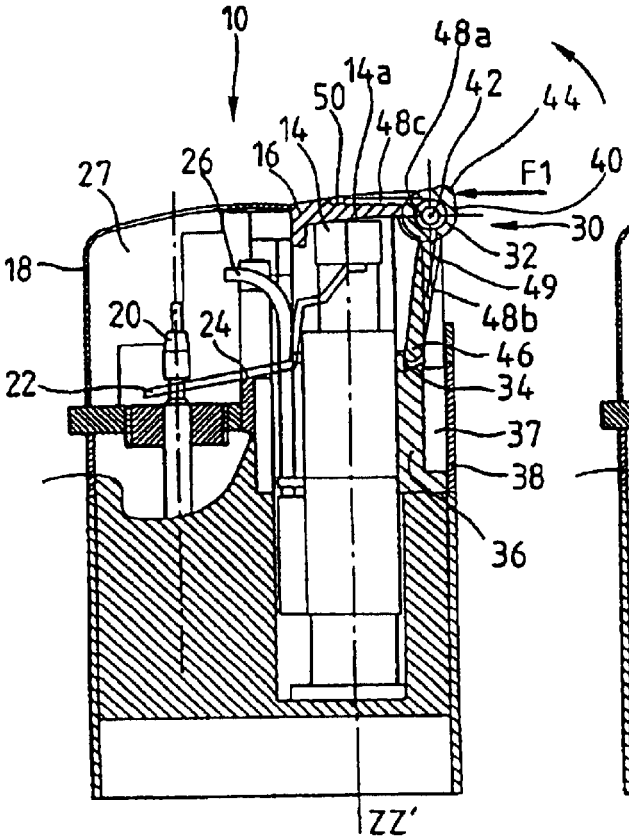
FIG. 2*a* is a partial longitudinal section view of a lighter according to a first embodiment of the invention, in a first position.

The lighter in FIG. 1 is partially shown in a schematic longitudinal section in FIG. 2*a*.

As stated above, the lighter comprises a flame generation device which is known to one skilled in the art and which comprises in particular the body of the actuator 14 equipped at the end 14*a* with cap 16.

This cap is considered as forming part of the actuator.

The flame generation device also comprises a gas jet release member 20, such as a nozzle connected to a gas filled reservoir and not shown in the figures.

The flame generation device also comprises a member 22 resting on a pivot 24 and forming a lever.

Member 22 has two ends each of which is in contact respectively with the actuator and the gas jet release member.

The lighter of the invention operates according to the known principle of the piezoelectric effect in which a piezoelectric element, such as a crystal, is struck by a member forming a hammer to produce an electric spark.

Figure 2B:
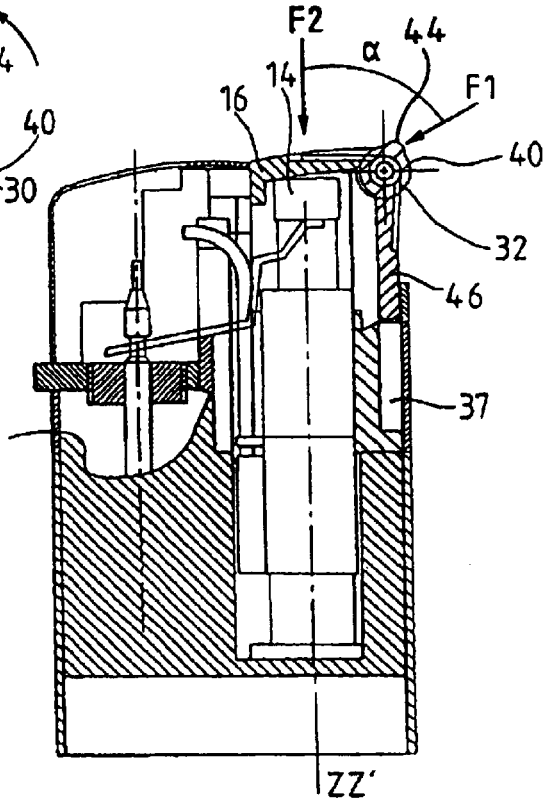
FIG. 2*b* is a view of the lighter of FIG. 2*a* in a second position.
Figure 2C:
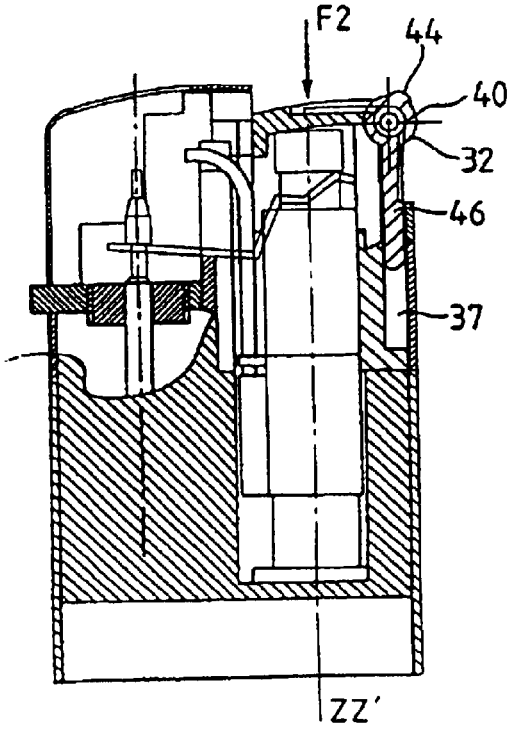
FIG. 2*c* is a view of the lighter of FIG. 2*a* in a third position.

The end of the actuator 14 opposite end 14*a* and which is not shown in the figures forms a hammer which strikes a piezoelectric element when the actuator is displaced by a force applied by the user's finger to cap 16, from a rest position, shown in FIG. 2*a*, wherein the flame generation device cannot generate a flame, to a active position, shown in FIG. 2*c*, and wherein the device can generate a flame.

The flame generation device further comprises an electrical conductor 26 whereby a spark generated by the aforementioned piezoelectric mechanism is propagated.

The electrical conductor 26 is electrically connected to the piezoelectric mechanism by one of its ends in a known manner.

The electrical conductor 26 terminates at its opposite end in a combustion chamber 27 wherein the aforementioned gas jet release member 20 also terminates.

During the movement of the actuator shown by its extreme positions in FIGS. 2*a* and 2*c*, member 22 forming a lever pivots about its support point 24 when the actuator applies a pressure to the end thereof, permitting upward displacement of the nozzle of the gas jet release member and thereby the release of the gas.

As shown in FIG. 2*c*, in the upper position, the nozzle is at the height of the end of the electrical conductor 26 via which the spark exits, thereby permitting the generation of a flame.

The above description relates to the three embodiments illustrated in FIGS. 2 to 5 and will therefore not be repeated in the description of each new embodiment.

FIGS. 2*a*, 2*b*, 2*c*, 2*d*, 3*a*, 3*b* and 3*c* more particularly illustrate a first embodiment of a lighter according to the invention.

The lighter according to this first embodiment of the invention comprises a safety mechanism denoted 30 in FIG. 2*a* which is mobile between two positions shown respectively in FIGS. 2*a* and 2*b* and to which we shall subsequently return.

The safety mechanism 30 comprises a safety member 32 which cooperates with an abutment 34 joined to the lighter.

The abutment 34 is in the form of a groove made in the upper end of a wall 36 of the lighter along which the actuator 14 is arranged.

This groove is generally V-shaped with an upward directed opening and which is slightly tilted to the longitudinal direction ZZ' so that one of the sides of the V is aligned with this direction.

The tilt of the V thereby serves to release the safety member from its abutment whenever necessary.

It should be noted that the abutment 34 could also be in the form of a flat horizontal portion.

The lighter further comprises a wall 38 visible from the exterior of the lighter, which is arranged facing wall 36 and at some distance therefrom, thereby arranging between the parallel walls a housing which is elongated along an axis parallel to longitudinal axis ZZ'.

Figure 3A:
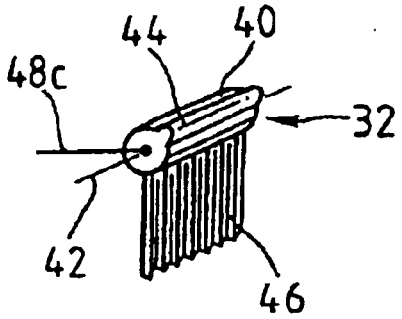
FIG. 3*a* is a view of a safety member used in the lighter of FIG. 2*a* and incorporating a spring.
Figure 3B:
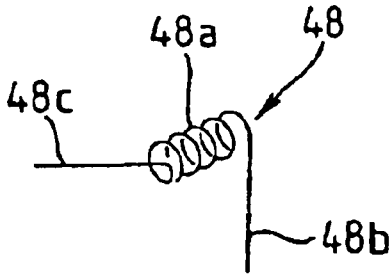
FIG. 3*b* is a view of the spring used in the safety member of FIG. 3*a;*
Figure 3C:
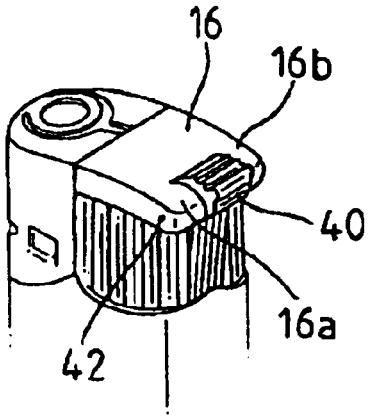
FIG. 3*c* is a partial perspective schematic view of the upper portion of the lighter of FIGS. 1 and 2*a;*

Safety member 32 which is shown in greater detail in FIGS. 3*a*, 3*b* and 3*c*, comprises an essentially cylindrical bearing portion 40 which is arranged around a pivotal axis 42.

As shown in FIGS. 2*a* to 2*d*, the bearing portion 40 of the safety member is arranged at the level of the end 14*a* of actuator 14 and, more particularly, of the cap 16 thereof.

As shown in FIG. 3*c*, cap 16 comprises two arms 16*a* and 16*b* arranging a space between themselves to receive the bearing portion 40 of the safety member.

Arms 16*a* and 16*b* respectively comprise an orifice passing through them to receive axis 42 of the safety member.

This axis 42 acts as a pivotal axis for the movement of the safety member between the positions shown in FIGS. 2*a* and 2*b*.

Axis 42 is arranged perpendicular to longitudinal axes ZZ'.

Thus safety member 32 is fixed to the cap of the actuator via its axis 42.

As shown in FIGS. 2*a* and 3*a*, bearing portion 40 is grooved to facilitate the gripping movement applied by the user of the lighter to this portion.

Furthermore, in addition to the grooves, the bearing portion comprises a boss 44 which facilitates handling by the user.

However, it must be noted that the simultaneous presence of grooves and a boss or of any other means to facilitate the handling of the safety member by the user is not mandatory, and that a single one of these means can suffice.

As shown in FIGS. 2*a* and 3*a*, the safety member comprises an active portion which, for example, is in the form of a flange 46 attached to the bearing portion 40 and essentially planar in shape.

When the safety member is in the position shown in FIG. 2*a* corresponding to the locked position of the safety mechanism of the invention, the active portion 46 of the safety member is disposed against abutment 34.

The active portion 46 of the safety member is tilted with respect to the longitudinal axis ZZ' towards the actuator 14.

In particular, the safety member comprises a spring 48 shown in FIG. 3*b* which has a central portion 48*a* shown in the form of a coil spring, and two end portions 48*b* and 48*c* forming the ends of the spring, the end portion 48*c* being shown in FIG. 3*a*.

The central portion 48*a* of this spring is mounted about the pivotal axis 42 inside the bearing portion 40 of the safety member and one of the end portions 48*b* of the spring is arranged inside the active portion 46 of the safety member in a recess 49 provided for the purpose, as shown in FIG. 2*a*.

The other end portion 48*c* of the spring forms an inactive portion of the safety member and is arranged inside the cap 16 in a housing 50 provided for the purpose (FIG. 2*a*).

As shown in FIG. 2*a*, the two end portions 48*b* and 48*c* of spring 48 make an angle smaller than 90° between each other, according to this side view.

The spring thereby applies a torsion force which resists any action tending to separate its end portions 48*b* and 48*c* from one another to open the angle between them.

When the spring is integrated in the safety member 32, as shown in FIGS. 2*a* and 3*a*, the torsion force applied by this spring forces the active portion 46 to abut wall 36, thereby forcing the active portion 46 and inactive portion 48*c* to make an angle smaller than 90° between one another.

The safety mechanism thereby formed, due to the force applied by the spring to the active portion 46 of the safety member 32, is elastically maintained in its locked position shown in FIG. 2*a*.

The safety member thereby formed makes a member which is mounted on the actuator.

Thus the presence of the safety member does not put into question the entire design of the actuator.

Furthermore, the arrangement of the safety member on the cap of the actuator is extremely simple to achieve.

When the safety mechanism is placed in the locked position, as shown in FIG. 2*a*, the active portion 46 is held in contact elastically with the abutment 34 in a tilted position with respect to the longitudinal axis ZZ' which is vertical in the drawings.

In this position, it is impossible for a user to displace actuator 14 by applying a vertical or inclined force to cap 16 and hence it is not possible to generate a flame.

An unintended user such as a child, for example, who tries to press on cap 16, therefore cannot succeed in generating a flame in the lighter.

Such an inclined arrangement of the active portion of the safety member, in the locked position of the safety mechanism, is particularly advantageous in relation to a vertical arrangement, since an unauthorized user pressing hard on the cap 16 and the safety member would be liable to unlock the safety mechanism by force if the arrangement of the active part were to be vertical.

Furthermore, with such a vertical arrangement of the active portion of the safety member, the risk of unlocking by force would be all the higher if the unauthorized user exerted a force inclined with respect to the vertical with more or less the same orientation as the active part.

Safety in relation to the unauthorized user is thus increased with the arrangement provided by the invention.

Given the fact that the safety member is in a position which is off-centered in relation to the cap and particularly to the portion of the cap to which the force must be applied to generate a flame, the safety mechanism of the invention is hence more reliable than those of the prior art discussed above.

It has been found that the forces applied to the cap of the lighter to cause its depression and hence to generate a flame are generally applied along longitudinal axis ZZ' or along a direction tilted to the axis.

By following this observation, it proves that the safety mechanism proposed in the lighter described in U.S. Pat. No. 5,145,358 is less reliable than the one of the present invention.

In fact, a force applied by an unintended user such as a child along a direction tilted to the longitudinal displacement axis of the actuator can permit the displacement of the grooved portion arranged on the cap of the actuator and forming a lock, thereby unlocking the safety mechanism.

By contrast, according to the present invention, the applicant has tilted the active portion 46 of the safety member to the longitudinal axis ZZ' of the actuator in the direction of the actuator so that, even under the action of a force applied in an oblique direction to longitudinal axis ZZ', the active portion of the safety member remains disposed against abutment 34, thereby keeping the flame generation device blocked.

To unlock the safety mechanism 30 according to the invention, it is necessary to pivot safety member 32 about the pivotal axis 42 to separate the active portion 46 of the safety member from the abutment and the lighter and to bring it to face housing 37.

The active portion 46 of the safety member pivots in the opposite direction to the moment forced by the user on the bearing portion 40 of that member and which is shown by arrow F1 in FIG. 2*a*.

The pivoting motion of the safety member is made independently of the movement of the actuator, which remains immobile during the displacement of the safety member.

The displacement of the safety mechanism from the locked position in FIG. 2*a* to the unlocked position in FIG. 2*b* is achieved by the user of the lighter by applying a tangential force to the bearing portion 40 of safety member 32, in order to rotate it about pivotal axis 42, the force being applied towards the cap of the actuator.

The movement applied by the user is facilitated by the presence of a grooved surface on the bearing portion 40 and of the boss 44 of the bearing portion.

As shown in FIG. 2*a*, the thrust force applied by the authorized user is shown by arrow F1 which is initially disposed at least horizontally, in fact the user from the outset being able to apply to the bearing portion of safety member 32 a force in a direction slightly tilted to the horizontal.

As shown in FIG. 2*b*, when the pivoting motion of the safety member has been completed in the direction of the arrow of FIG. 2*a*, the force F1 applied by the user to the bearing portion of the safety member and, in particular, to the boss 44 thereof, is applied along an axis forming an even greater tilt than previously to the horizontal, thereby facilitating the application of a second force F2 applied along longitudinal direction ZZ' to displace the actuator from its rest position to its active position, as shown in FIGS. 2*b* and 2*c*.

The fact that the directions of application of forces F1 and F2 (FIG. 2*b*) make an angle $\alpha$ between one another less than 90° further facilitates the coordination of the two forces.

It should be observed that when the initial force applied by the user to pivot the safety member about its axis is not horizontal but already has a certain tilt to the horizontal, force $F_1$ applied by the user to the safety member, as shown in FIG. 2*b*, makes an even smaller angle $\alpha$ to the longitudinal direction (axis ZZ') of displacement of the actuator, thereby facilitating the use of the lighter.

As shown in FIG. 2*b* and indicated above, in the unlocked position, the active portion 46 of safety member 32 is vertically disposed facing housing 37 and, under the effect of the second force denoted F2 in FIG. 2*c*, engages in the housing.

It must be observed that the pivoting motion of safety member 32 has an amplitude which corresponds to the angle made by the active portion of the member with the longitudinal displacement axis of the actuator.

The amplitude of this motion is preferably small to avoid making the lighter too difficult to use by the intended user.

Figure 2D:
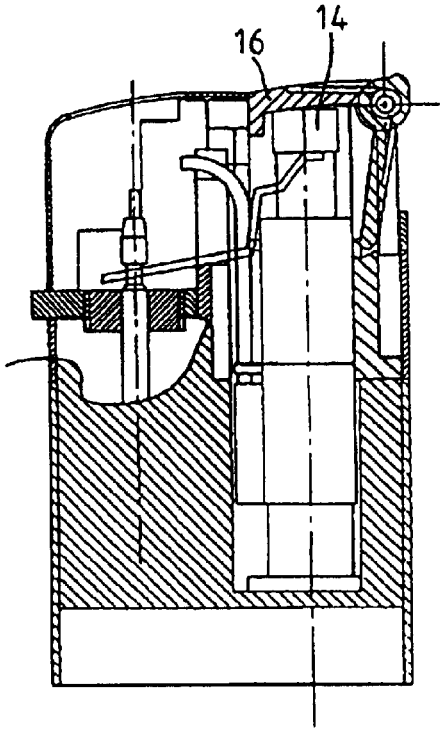
FIG. 2*d* is a view of the lighter in a position identical to the first position.

As shown in FIG. 2*d*, when the user stops applying a force $F_2$ to cap 16 of the actuator, the actuator is returned to its initial rest position identical to that shown in FIG. 2*a* under the action of a spring not shown in the figures and known in this type of lighter and which has been compressed during the displacement of the actuator between FIGS. 2*b* and 2*c*.

During this upward motion, the active portion 46 of the safety member rises inside housing 37 and, when it exits therefrom, is then subject to the sole action of spring 48, thereby bringing it again into an inclined position against abutment 34.

The safety mechanism is thereby returned to its locked position wherein the flame generation device is blocked.

FIGS. 4*a* to 4*e* illustrate a second embodiment of a lighter according to the invention.

It should be recalled that the items described with reference to FIG. 2*a* to second, except for cap 16 and the safety member 32, remain the same and keep the same reference numbers as those of the figures.

In fact, in this second embodiment, only the structures of the cap and the safety member are modified in comparison with those of the first embodiment.

According to this second embodiment, the lighter 60 further comprises a safety mechanism 62 comprising a safety member 64 cooperating with an abutment joined to the lighter.

Figure 4B:
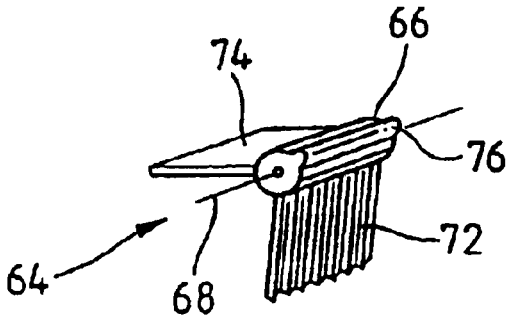
FIG. 4*b* is a perspective view of a safety member used in the lighter of FIG. 4*a;*

As shown in greater detail in FIG. 4*b*, safety member 64 comprises a bearing portion 66 whose function is similar to that of bearing portion 40 in FIG. 3*a* and which is arranged about a pivotal axis 68.

This pivotal axis connects safety member 64 to cap 70 in the same way as safety member 32 in FIGS. 3*a* to 3*c*.

Figure 4A:
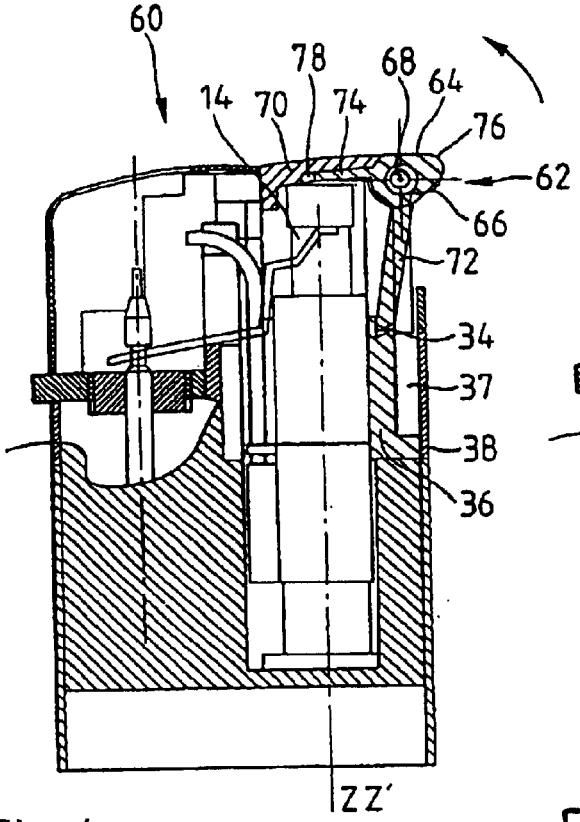
FIG. 4*a* is a view of a lighter according to a second embodiment of the invention, placed in a first position.

Safety member 64 also comprises two portions, one, active, denoted 72, adapted to comes against the abutment 34 when the safety member is in the locked position, as shown in FIG. 4*a*, and an inactive portion 74 which is adapted to be positioned between cap 70 of the actuator and the body of the actuator.

In a similar manner as described for safety member 32 shown in FIGS. 2 and 3, safety member 64 comprises a bearing portion 66 arranged about the pivotal axis 68, the active portion 72 being in the form of a flange attached to the bearing portion 66, and the inactive portion 74 also being in the form of a flange attached to bearing portion 66.

Bearing portion 66 is grooved and also comprises a boss 76 which is shown in FIGS. 4*a* and 4*b*.

When the safety member is installed on the lighter, the safety member is fixed to the actuator via its pivotal axis 68 in the same way as the fixing of safety member 32 to actuator 14 as shown in FIG. 3*c*.

Furthermore, the inactive portion 74 of the safety member is held pressed into a housing 78 provided between cap 70 and the body of the actuator 14 (FIG. 4*a*), in a position preventing its pivoting.

It must be observed that the flange forming the inactive portion 74 of the safety member has a reduced thickness in comparison with the thickness of the bearing portion 66 and of the other flange 72.

This difference in thickness confers a degree of elasticity on safety member 34 enabling it to be deformed elastically, in a limited manner, during the pivoting motion about axis 68.

Note that when the safety member is installed on the lighter, the active portion 72 and inactive portion 74 naturally make an angle smaller than 90° between each other, in order to give the active portion 72 a tilted position with respect to the longitudinal axis ZZ' when the safety mechanism is in the locked position.

In this position shown in FIG. 4*a*, safety mechanism 62 according to the invention is in the locked position and active portion 72 of the safety member is arranged in tilted position against abutment 34, which gives increased safety with respect to unauthorized users according to the explanations given above with reference to FIGS. 2*a* to 3*c*.

Figure 4C:
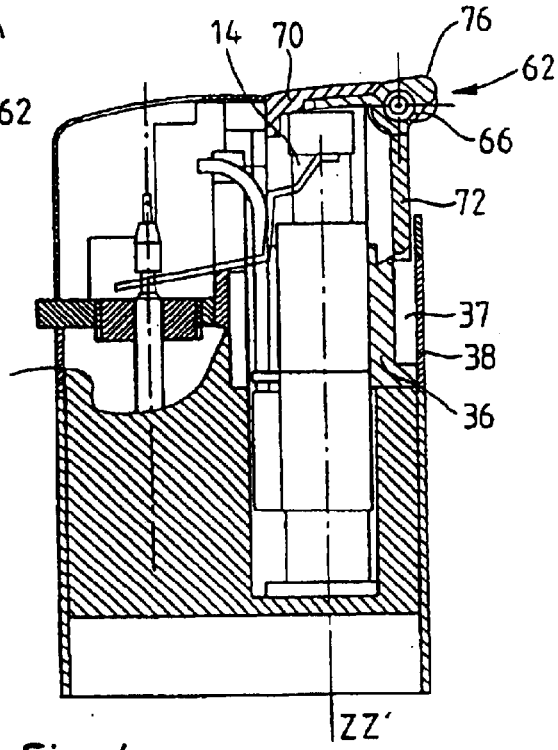
FIG. 4*c* is a view of the lighter of FIG. 4*a* in a second position.

In a similar manner to that described for the first embodiment, to go from the locked position of the safety mechanism, as shown in FIG. 4*a*, to the unlocked position thereof shown in FIG. 4*c*, the user of the lighter employs the boss 76 to cause the active portion of the safety member 64 to pivot about its axis 68, thereby bringing active portion 72 facing housing 37.

As stated above in reference to FIGS. 2 and 3 of the first embodiment of the invention, the tilt to the horizontal and to axis ZZ' of the force applied by the user to the safety member at the end of the pivoting motion makes it easy to coordinate this movement with the displacement of the actuator along axis ZZ'.

Figure 4D:
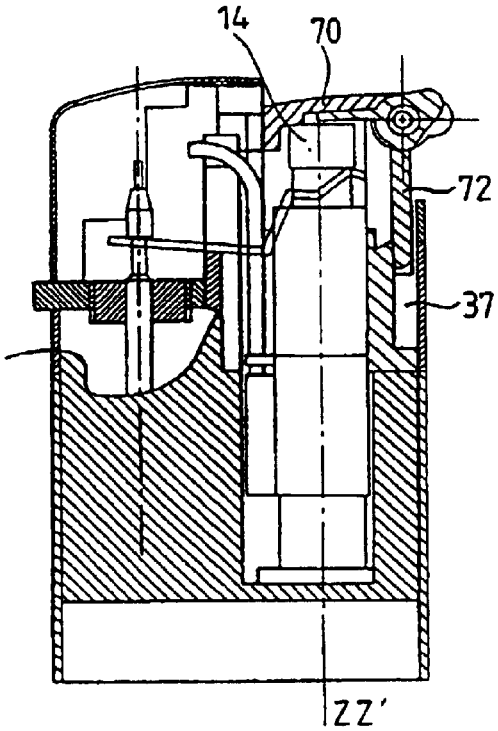
FIG. 4*d* is a view of the lighter of FIG. 4*a* in a third position.
Figure 4E:
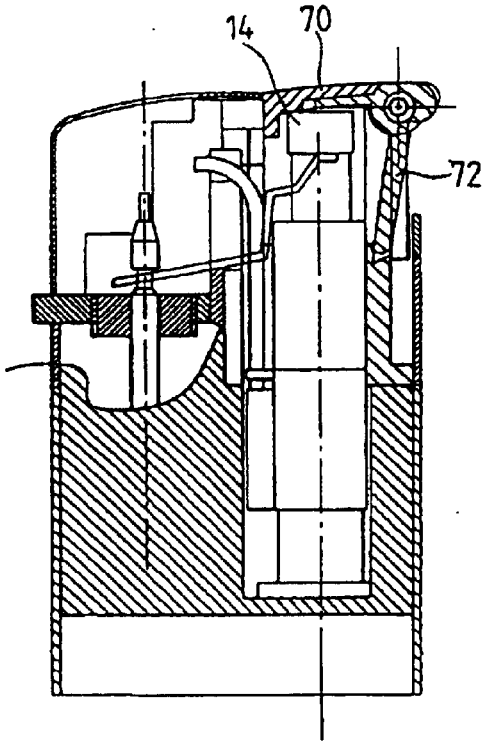
FIG. 4*e* is a view of the lighter in a position identical to the first position.

As shown in FIG. 4*d*, active portion 72 of the safety member engages in housing 37 as the user applies a vertical downward pressure to actuator 14.

When the pressure applied by the user to the actuator is released, the actuator rises under the action exerted by a spring not shown in the figures and, on returning to its rest position, shown in FIG. 4*c*, the safety member naturally returns to its locked position due to the elastic deformation it had undergone between the positions shown in FIGS. 4*a* and 4*c*.

FIGS. 5*a* to 5*d* show a third embodiment of the invention wherein the safety member forms one and the same member with the actuator.

All the elements forming part of the lighter described in the first two embodiments, but with the exception of the cap, the safety member and its abutment, are not modified in this embodiment and, when mentioned, retain the same numerals as previously.

Figures 5A, 5B, 5C, 5D, 5E:
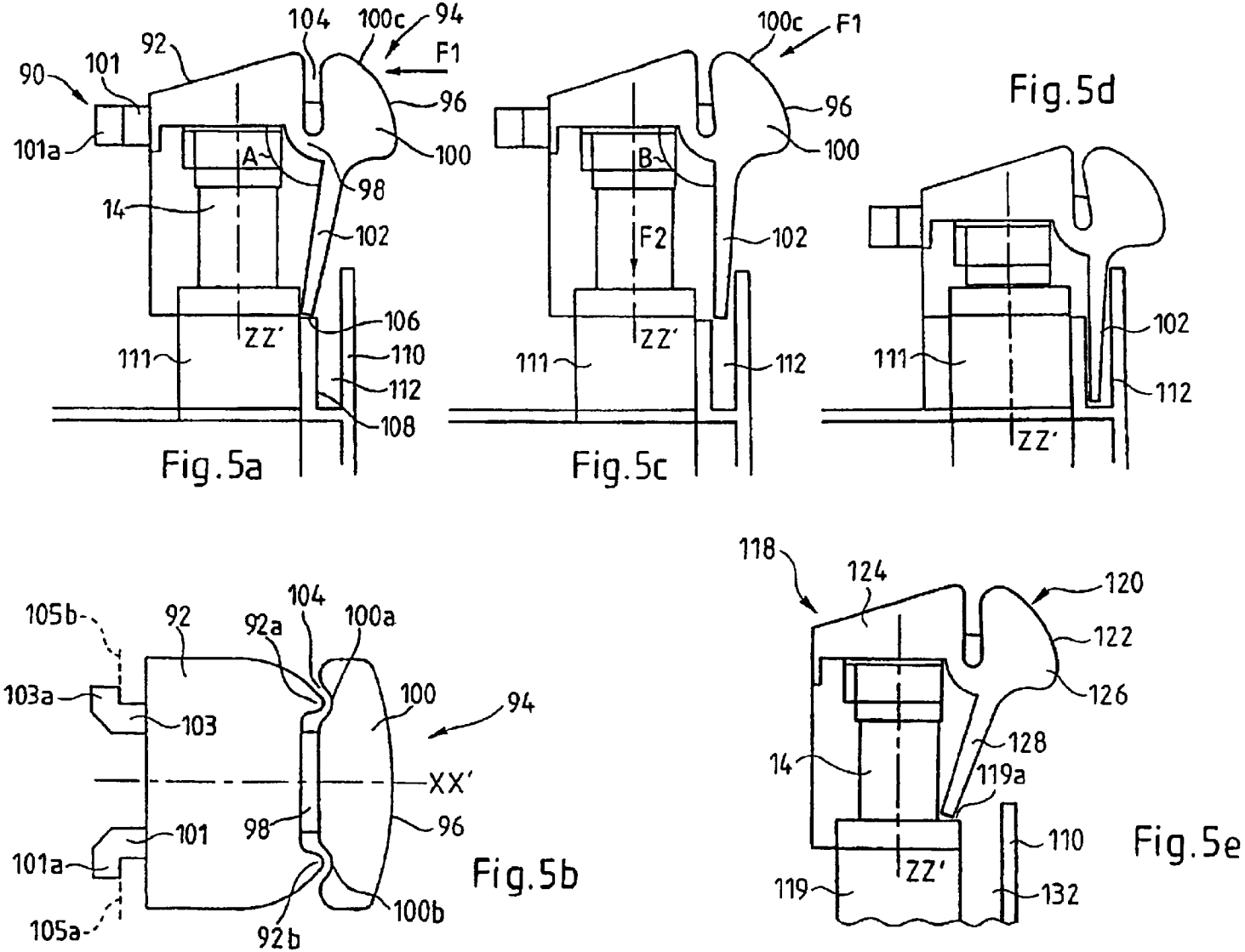
FIG. 5*a* is a partial schematic view of a lighter according to a third embodiment of the invention, placed in a first position.
FIG. 5*b* is a partial plan view of the lighter of FIG. 5*a;*
FIG. 5*c* is a view of the lighter of FIG. 5*a* in a second position.
FIG. 5*d* is a view of the lighter of FIG. 5*a* in a third position.
FIG. 5*e* is a schematic view of a variant embodiment of the lighter shown in FIG. 5*a*.

As partially shown in FIG. 5*a*, the lighter according to a third embodiment identified by the general reference denoted 90, comprises an actuator 14 identical to the one shown in FIGS. 2 and 4, but with the exception of cap 92 of actuator 14.

In this embodiment, the lighter comprises a safety mechanism 94 with a safety member 96 that is an integral part of the actuator in the sense that it is joined to the cap 92 via a curved arm 98.

Safety member 96 comprises two parts: an actuating head 100 and an active portion 102 extending from head 100 and from arm 98 and forming a flange.

The arm has a general U-shape whereof the concavity is turned towards actuating head 100.

This arm represents a sort of articulation of the safety member with respect to cap 92 of the actuator.

Actuating head 100 and flange 102 confer on safety member 96 a general T-shape where the head consists of the actuating head and which has a leg formed by the flange.

FIG. 5*b* shows the actuating head of the safety member in a plan view.

Safety member 96 and cap 92 are connected by curved arm 98 whereof the thickness is reduced in comparison with that of the rest of the safety member to permit a limited elastic deformation of the arm during the pivoting motion of the safety member.

The pivoting motion takes place about an axis which is placed at the level of the arm.

Also provided is a space 104 between actuating head 100 and cap 92 of the actuator to permit the actuating head to move in the direction of the cap, during the pivoting motion of the safety member towards its unlocked position.

However, it must be observed in FIG. 5*b* that cap 92, with respect to its median axis XX', has two portions forming a projection towards two concavities arranged in actuating head 100 and which are each symmetrical about the aforementioned median axis.

The cap further comprises two arms 101 and 103 provided at their free ends with two outwardly directed shoulders 101*a* and 103*a*.

The free ends of the arms provided with shoulders are engaged within the portion of the lighter surrounded by portion 18 in FIG. 1 and enable the cap to be connected to the rest of the lighter by virtue of the shoulders which bear against walls 105*a* and 105*b* of the lighter partially represented by dashed lines in FIG. 5*a*. These ends also facilitate the guidance of the axial displacement of the cap.

Such arms also exist on the lighters shown in the earlier Figures although they are not represented.

Space 104 is thus more particularly provided between each projecting portion 92*a* (respectively 92*b*) and the corresponding concavity 100*a* (respectively 100*b*) of the actuating head.

Safety member 96 comprises a bearing portion 100*c* to which the user's force is applied, thereby permitting the safety member to make its pivoting motion.

In the representation thereof in the figures, the bearing portion is only one portion of actuating head 100.

In FIG. 5*a*, the safety member is in its locked position wherein active portion 102 of the member is arranged in a position inclined towards the actuator 14 with respect to the axis ZZ' and in contact with an abutment 106 provided in the upper portion of a wall 108 along which the a block 111 is disposed in which the actuator 14 is arranged.

In this position, it is however unnecessary for active portion 102 to be in contact with abutment 106, the contact only occurring when the unauthorized user of the lighter applies a pressure to cap 92 to displace the actuator downward.

It will be noted that the angle A formed by the active portion 102 with the horizontal is less than 90° in FIG. 5*a* and that this arrangement gives the same advantages as those described with reference to the first two embodiments.

The lighter further comprises another wall 110 disposed facing wall 108 and thereby providing a housing 112 with it.

In a similar manner to that described for the first two embodiments of the invention, the pivoting motion of safety member 96 is obtained via a first tangential force F1 applied by the intended user of the lighter in a direction forming a positive or zero angle with the horizontal, as shown by the arrow in FIG. 5*a*.

The user applies this force to the bearing portion 100*c* of the safety member.

When the user has applied this force until contact is obtained between the projecting portions 92*a* and 92*b* and the respective concavities 100*a* and 100*b* of the actuating head 100, any subsequent deformation is made impossible due to the disappearance of the space 104 between cap 92 and actuating head 100.

The user thereby knows that the safety mechanism is in the unlocked position.

The active portion 102 forms an angle B with the horizontal which is substantially equal to 90°.

In this position shown in FIG. 5*c*, the user is naturally guided in the following movement which consists in pressing on cap 92 in the direction of force F2 of the axis ZZ' in order to move the actuator downwardly. This is due to the fact that the direction of the first force F1 applied by the user at the end of the pivoting motion (FIG. 5*c*) forms an angle less than 90° with the direction of the axis ZZ'.

It must be observed that the cap has a non-uniform thickness and which is greater in its part disposed facing the actuating head, thereby forming a tilted plane as shown in the figures, to receive the user's finger.

Thus when the safety mechanism is in the unlocked position (FIG. 5*c*) and the user applies a vertical force to lower the actuator within block 111, active portion 102 of safety member 96 is arranged facing housing 112, thereby enabling the safety member to engage therein progressively with the downward movement of the actuator, to come into abutment at the end of housing 112 when the actuator is in its active position (FIG. 5*d*).

The return to the rest position of the actuator and to the locked position of the safety mechanism takes place, for the user, by releasing the pressure applied to cap 92, as indicated for the first two embodiments.

The lighter thereby returns to the position shown in FIG. 5*a*.

Note that it is advantageous in the three embodiments described above either to fix or to consolidate the safety member with the actuator cap and not the actuator body itself, or to have the safety member as a component mounted on the cap in order to simplify the manufacture of the lighter of the invention.

In fact, with a mechanism as described in U.S. Pat. No. 5,833,448, the entire design of the actuator must be reviewed to install such a safety mechanism, complicating and thereby increasing the production cost of the lighter.

FIG. 5*e* shows a variant embodiment of the lighter shown in FIGS. 5*a* to 5*d* in which only the position of the safety member in abutment is modified.

The lighter 118 comprises the actuator 14 and a block 119 in which the actuator is inserted and within which it may engage when it is displaced from its rest position to its active position.

A safety mechanism 120 comprises a safety member 112 which is jointed to the cap 124.

The safety member comprises an actuating head 126 and an active portion 128 which, in the locked position of the safety mechanism, is tilted towards the actuator 14 with respect to the longitudinal axis ZZ' and which is provided on the upper portion 119*a* of the block 119, instead of resting on the top of the wall 106 of FIG. 2*a*.

More particularly, the active portion 128 is in contact with the upper portion 119*a* of the block 119 via a portion which may be simply a portion of an edge (e.g. a ridge) of this active portion and with the vertical body of the actuator 14 via another portion of an edge.

These horizontal and vertical contacts which may be linear in the case of ridges ensure that the active portion 128 is perfectly braced, thus enabling it to resist equally a vertical push and an oblique force.

It will thus be understood that it is not necessary for the portions of the active portion 128 which are in contact with the block 119 and the actuator 14 to have a large area of contact with them.

Furthermore, the provision of the active portion 128 at the upper portion 119*a* of the block 119 rotor than on the top of the wall 106 of FIG. 2*a* advantageously enables the bulkiness of the system within the lighter to be reduced.

The space 132 which the active portion 128 enters in the unlocked position may thus be of reduced dimensions if the wall 106 of FIG. 2*a* is dispensed with.

Alternatively, if the dimensions of the space 132 are maintained while dispensing with the wall 106 of FIG. 2*a*, it is possible to receive a block 119 of greater size in the lighter.

Everything which has just been stated concerning the variant of FIG. 5*e* also applies to the lighters shown in the other Figures.

What is claimed is:

1. A lighter comprising:

a flame generation device;

an actuator mobile along a longitudinal axis between a rest position, wherein said device cannot generate a flame, and an active position, wherein said device can generate a flame; and a safety mechanism mobile between a locked position wherein said safety mechanism blocks the actuator in its rest position and an unlocked position enabling said actuator to move toward its active position, the safety mechanism comprising a safety member having an active portion, wherein, in the locked position of the safety mechanism, the active portion is disposed against an abutment and is tilted towards the actuator with respect to the longitudinal axis of said actuator and, in the unlocked position of the safety mechanism, said active portion is disposed facing a housing, and the safety member comprises a bearing portion which is adapted, under the action of a first force, to make a pivoting motion towards one end of the actuator to which a second force is applied to displace said actuator from its rest position towards its active position, said bearing portion being arranged at a level of said end of the actuator.

2. A lighter according to claim 1, wherein, to change position, the active portion of the safety member pivots with respect to the actuator while moving away from the actuator.

3. A lighter according to claim 1, wherein the safety mechanism further comprises an elastic means integrated in the safety member and elastically maintaining the safety member, in the locked position of the safety mechanism, so that the active portion is disposed against the abutment and, in the unlocked position of the safety mechanism, said active portion is disposed facing the housing.

4. A lighter according to claim 1, wherein, when the safety mechanism is in the unlocked position, the first force is applied to the bearing portion in a direction forming an angle less than 90° with another direction along which the second force is applied to the end of the actuator.

5. A lighter according to claim 3, wherein the safety member comprises the bearing portion whose pivotal movement has an amplitude corresponding to an angle of tilt formed between the active portion and the longitudinal axis of the actuator.

6. A lighter according to claim 1, wherein the pivoting motion is executed about an axis.

7. A lighter according to claim 6, wherein the safety member pivots about a pivotal axis perpendicular to the longitudinal axis of movement of the actuator.

8. A lighter according to claim 1, wherein, the active portion of the safety member forms a flange, and the safety member further comprises a spring having a central portion arranged inside a bearing portion of said safety member and around a pivotal axis, and two end portions, one end portion extending along the flange and the other end portion merging with the inactive portion maintained in position with respect to the actuator.

9. A lighter according to claim 1, wherein the housing is elongated along an axis parallel to the longitudinal axis of displacement of the actuator such that, in the unlocked position of the safety mechanism, the active portion of the safety member engages in said housing when the actuator passes from its rest position to its active position.

10. A lighter according to claim 1, wherein the active portion of the safety member forms a flange.

11. A lighter according to claim 1, wherein the actuator comprises a cap to which a force is applied for displacing said actuator from its rest position to its active position, the safety member being provided at a level of said cap.

12. A lighter according to claim 1, wherein the safety member forms at least one component mounted on the actuator.

13. A lighter according to claim 12, wherein the safety member is fixed to the actuator via a pivotal axis.

14. A lighter according to claim 13, wherein the safety member comprises a bearing portion which is arranged about the pivotal axis.

15. A lighter according to claim 14, wherein the flange of the safety member is mounted on the bearing portion.

16. A lighter according to claim 1, wherein the safety member comprises an inactive portion which is maintained in position with respect to the actuator.

17. A lighter according to claim 16, wherein the inactive portion maintained in position with respect to the actuator is a flange which has a reduced thickness compared with a thickness of the bearing portion of the safety member.

18. A lighter according to claim 16, wherein an angle formed between the active and inactive portions is less than 90° when the safety mechanism is in the locked position.

19. A lighter according to claim 1, wherein the bearing portion of the safety member is grooved.

20. A lighter according to claim 1, wherein the bearing portion of the safety mechanism comprises a boss.

21. A lighter according to claim 1, wherein the safety member forms one and the same member with the actuator.

22. A lighter according to claim 21, wherein the safety member forms one and the same member with the cap.

23. A lighter according to claim 22, wherein the safety member is connected to the actuator via an arm.

24. A lighter according to claim 23, wherein the arm has a curved general shape.

25. A lighter according to claim 24, wherein a pivotal axis is placed at the level of the arm.

26. A lighter comprising:

a flame generation device;

an actuator mobile along a longitudinal axis between a rest position, wherein said device cannot generate a flame, and an active position, wherein said device can generate a flame; and a safety mechanism mobile between a locked position wherein said safety mechanism blocks the actuator in its rest position and an unlocked position enabling said actuator to move toward its active position, wherein the safety mechanism comprises a safety member having an active portion which, in the locked position of the safety mechanism, is tilted towards the actuator with respect to the longitudinal axis of said actuator so as to be disposed against an abutment and, in the unlocked position of the safety mechanism, is disposed facing a housing, the safety member comprises an inactive portion which is maintained in position with respect to the actuator, the active portion of the safety member forms a flange, and the safety member further comprises a spring having a central portion arranged inside a bearing portion of said member and around a pivotal axis, and two end portions, one end portion extending along the flange and the other end portion merging with the inactive portion maintained in position with respect to the actuator.

27. A lighter comprising:

a flame generation device;

an actuator mobile along a longitudinal axis between a rest position, wherein said device cannot generate a flame, and an active position, wherein said device can generate a flame; and a safety mechanism mobile between a locked position wherein said safety mechanism blocks the actuator in its rest position and an unlocked position enabling said actuator to move toward its active position, wherein the safety mechanism comprises a safety member having an active portion which, in the locked position of the safety mechanism, is tilted towards the actuator with respect to the longitudinal axis of said actuator so as to be disposed against an abutment and, in the unlocked position of the safety mechanism, is disposed facing a housing, the safety member forms one and the same member with the actuator, and the safety member comprises an actuating head at least partially forming a bearing portion to which a force is applied to execute the pivoting motion and the flange forms the active portion of said member.

28. A lighter according to claim 27, wherein the actuating head and flange confer on the safety member a general T-shape having a leg that is formed of said flange.

29. A lighter according to claim 27, wherein a space is provided between the actuating head and the actuator.

* * * * *